US006687942B1

(12) United States Patent
Pember

(10) Patent No.: US 6,687,942 B1
(45) Date of Patent: Feb. 10, 2004

(54) WASHING PRODUCT WITH CLEANING AGENT DISPENSING AREA

(76) Inventor: Scott N. Pember, 218 Sleepy Hollow Dr., Amherst, OH (US) 44001

( * ) Notice: Subject to any disclaimer, the term of this patent is extended or adjusted under 35 U.S.C. 154(b) by 10 days.

(21) Appl. No.: 09/783,427

(22) Filed: Feb. 14, 2001

Related U.S. Application Data

(63) Continuation-in-part of application No. 09/221,073, filed on Dec. 28, 1998.
(60) Provisional application No. 60/070,123, filed on Dec. 31, 1997.

(51) Int. Cl.[7] ..... A47L 13/19; A47K 7/03
(52) U.S. Cl. ..... 15/227; 15/104.94; 15/118
(58) Field of Search ..... 15/118, 104.93, 15/104.94, 209.1, 210.1, 227

(56) References Cited

U.S. PATENT DOCUMENTS 1,941,320 A * 12/1933 Pamplin
1,990,030 A * 2/1935 Jaffe
2,103,455 A * 12/1937 Greenwald
2,210,754 A * 8/1940 Frank
2,265,329 A * 12/1941 Wachs
2,745,128 A * 5/1956 Zeuner
3,608,708 A * 9/1971 Storandt
3,775,014 A * 11/1973 Roasborne
3,806,260 A * 4/1974 Miller
3,885,249 A * 5/1975 De Brabander
4,154,542 A * 5/1979 Rasmason
4,959,881 A * 10/1990 Murray
5,248,211 A * 9/1993 Holst
5,473,789 A * 12/1995 Oster
5,815,840 A * 10/1998 Hamlin
5,956,770 A * 9/1999 Dennis

* cited by examiner

*Primary Examiner*—Terrence R. Till
(74) *Attorney, Agent, or Firm*—Fay, Sharpe, Fagan, Minnich & McKee, LLP

(57) ABSTRACT

A washing device such as a mit includes an open celled micro-cellular polyurethane absorptive/transmissive material which holds predetermined amounts of a cleaning agent such as soap, wherein the soap may be inserted within a pocket area or infused within the absorptive/transmissive material. Cleaning a surface with such a mit allows for a continuous supply of soap to be applied to the surface without the need of reinfusing the mit with soap.

3 Claims, 8 Drawing Sheets

WASHING PRODUCT WITH CLEANING AGENT DISPENSING AREA

This is a Continuation-In-Part of U.S. Ser. No. 09/221,073 filed Dec. 28, 1998 which claims priority to Provisional Application No. 60/070,123 filed Dec. 31, 1997.

BACKGROUND OF THE INVENTION

The present invention relates generally to cleaning products, and more particularly, to a product which delivers a cleaning agent, such as soap, to an item being washed.

Presently, when using a cleaning product (such as a mit) to wash items such as automobiles, motorcycles, bikes, tools, furniture, flooring, walls, as well as a person, pets or other items, it is necessary to separately apply the soap to the mit or item being washed and then use the mit for cleaning.

For example, when washing an automobile, it is necessary to have a washing mit, a bucket of soapy water, along with a hose for rinsing the automobile. It is then necessary to repeatedly dip the washing mit into the soapy water to apply or re-load sufficient soap to accomplish a thorough cleaning. These actions increase the time necessary to wash the automobile and also requires the use of a soapy bucket of water.

Further, when the mit is used to wash a person or animal, it is also necessary to have a separate supply of the cleaning agent applied either to the person or animal directly or onto the glove or mit. The cleaning agent is commonly held by the hand that is not in contact with the glove or mit increasing the inconveniences of the washing process. Specifically, it is common that the cleaning agent which may be a bar of soap or a bottle of liquid soap will slip out of the person's hand, which increases the difficulty of the washing procedure.

To address the foregoing shortcomings, an absorptive/transmissive material is attached to a cleaning product of the present invention such as the mit in a manner which allows it to hold a certain amount of cleaning agent in a contained area while the mit is not being used. It is further designed that the absorptive/transmissive material allows the cleaning agent to be transmitted through the material to the surface being washed when pressure is applied between the transmissive material and the surface. In this way, a consistent release of cleaning agent is provided to the surface being washed, and there is no need to separately apply soap to the mit or surface. Therefore, it becomes unnecessary to provide a soapy bucket of water, and also eliminates the mishandling of bars of soap or bottles of liquid soap.

Thus, the present invention contemplates a new and improved washing product that overcomes the above-noted problems and others, and is of a durable construction made of materials appropriate for an item being washed. The absorptive/transmissive material holding the cleaning agent is selected so as not to cause damage to the item being washed, while at the same time allowing sufficient cleaning agent to be delivered to the surface of the item to provide for thorough cleaning of the item.

A principle advantage of the invention is the provision of a mit with a absorptive/transmissive material which allows for one-step cleaning processes, and which does not require a separate source of cleaning agent to be applied to the mit or surface during the cleaning process.

Another advantage of the present invention is the use of the absorptive/transmissive material whereby the user may control the transmission of cleaning agent to the surface dependent upon pressure applied to the transmissive/absorptive material.

Another advantage of the invention resides in the improved convenience and speed of the washing process by eliminating the need of separately applying a cleaning agent to the mit or surface being cleaned and thereby further eliminating the need of separate sources of cleaning agent such as a soapy bucket of water.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
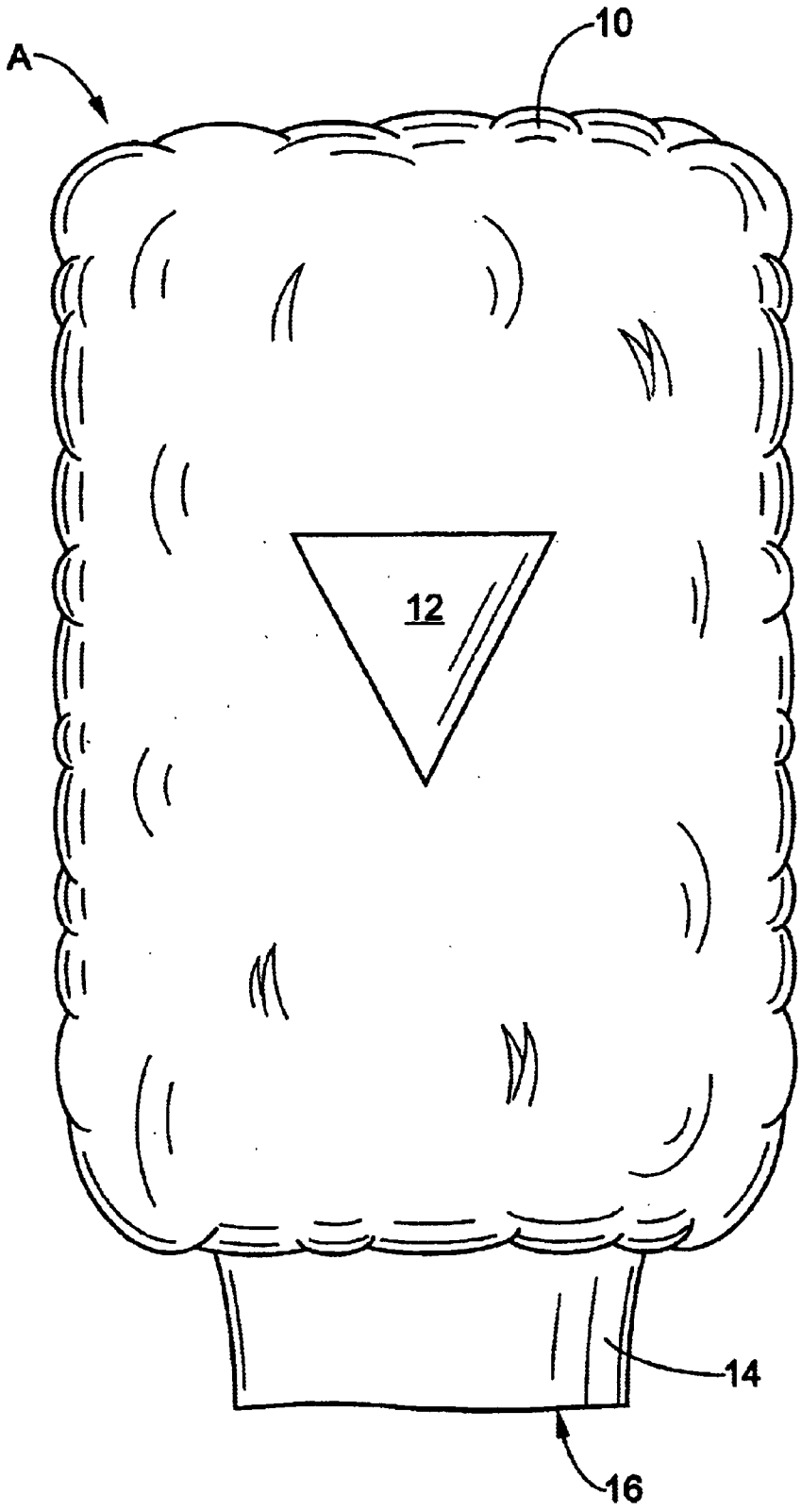
FIG. 1 is a front view of a cleaning mit according to the teachings of the present invention.
Figure 2:
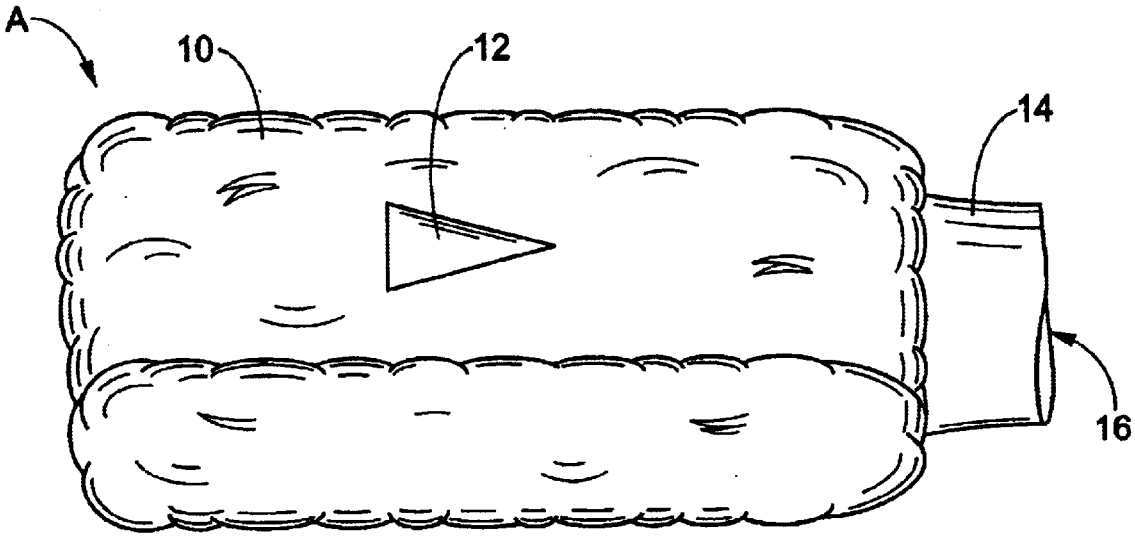
FIGS. 2 and 3 illustrate alternative views of FIG. 1.
Figure 3:
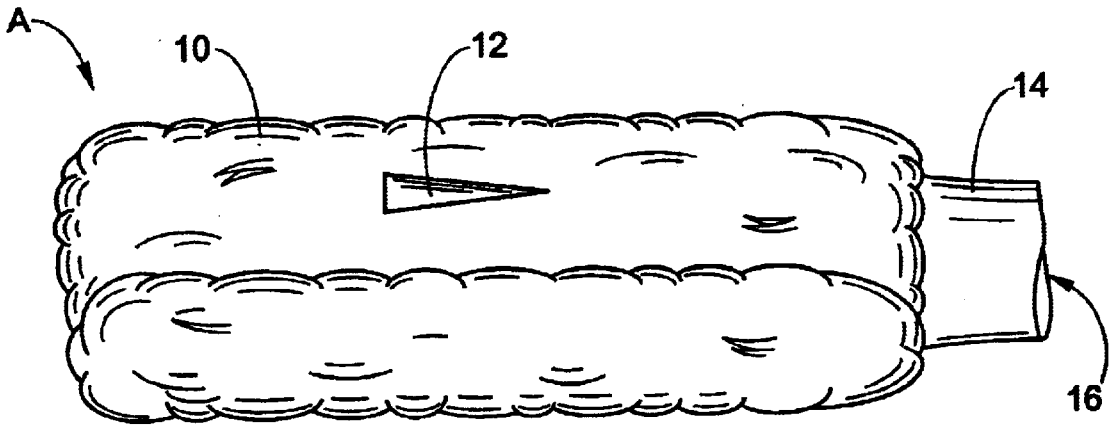

Referring now to the drawings wherein the showings are for purposes of illustrating a preferred embodiment of the invention only and not for purposes of limiting same, FIG. 1 illustrates mit A in accordance with the concepts of the present invention. Mit A is shown in a rectangular shape, however, it may be shaped in other forms including a circular, oblong, square or other configuration appropriate for a particular use. The main elements of mit A include cleaning area 10, soap absorptive/transmissive material or patch 12, and cuff 14. Washing area 10 may be formed into a mit configuration by well known manufacturing processes. The washing area 10 may be made of many different fabrics dependant upon the use of the mit. For example, washing area 10 can be made from any type of fleece, pile material, acrylic polyester, wool, cotton or combination of these or other materials.

As shown in the drawings, cuff 14, which may be made from elastic, cotton, polyester or similar material, has an opening 16 for receiving the user's hand or other support. Preferably, opening 16 is smaller in width than the diameter of the body of mit A. The purpose of making opening 16 smaller is to prevent the user's hand from easily slipping out of mit A. It is to be understood that mit A may also be designed without cuff 14.

Patch 12 is affixed to the washing area 10 in a manner that allows a cleaning agent, to be poured unto, poured into, or in some other manner to be associated with the patch. The cleaning agent includes but is not limited to liquid soap, dry soap, such as a bar of soap or dry crystal soap.

It is also to be appreciated that washing area 10 may be found on both the surface with the absorptive/transmissive patch 12, or on a side without the absorptive/transmissive patch 12. Additionally, mit A may have patch 12 on both sides of mit A.

Washing area 10 is sewn or otherwise attached together to form an inner hand receiving area, and thereafter cuff 14 is attached to the open end through which a hand enters the inner area.

Patch 12 may be any material which allows for the absorption and holding of a soap when not being used, and for transmission of the soap to the washing surface upon proper application and use. Thus, patch 12 may be any type of cell foam, a simple sponge, PORON (an open cell urethane foam) (is a trademark of Rodgers) or FOAMEX (a polyurethane foam) (is a trademark of Fomex) felt. Additionally, patch 12 may be an abrasive material for cleaning surfaces which are not concerned with scratching.

Figure 6:
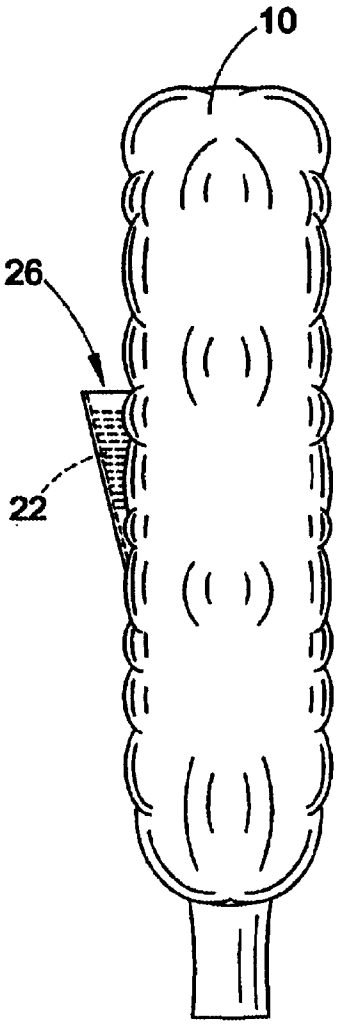
FIGS. 4–6 illustrate alternative views of the cleaning area and patch of the mit of the present invention designed with a pocket portion.
Figure 5:
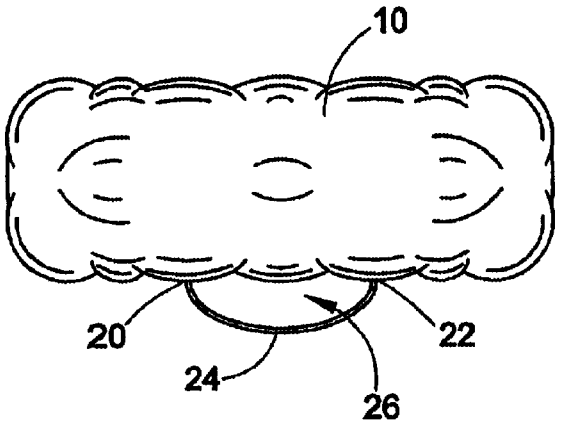
Figure 4:
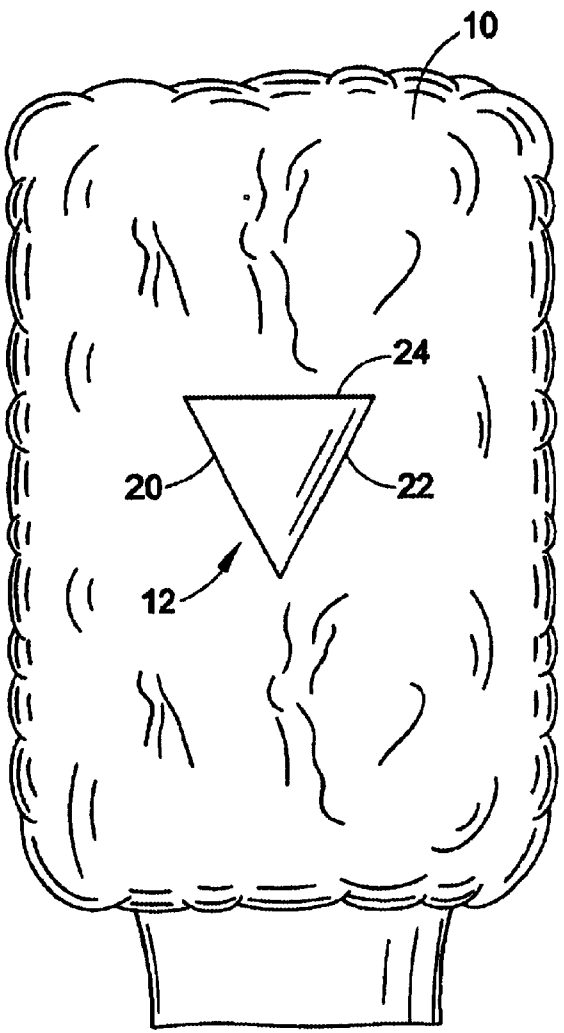

FIG. 4 is a close-up front view of patch 12 connected to washing area 10. In this embodiment, sides 20 and 22 are attached to washing area 10 and upper surface 24 is not connected, to thereby form a pocket 26 between the surface of washing area 10 and inner surface of patch 12. This is shown more clearly in FIGS. 5 and 6 wherein FIG. 5 is a top view of FIG. 4, and FIG. 6 is a side view of FIG. 4. As can be seen in these drawings, pocket 26 is formed in which liquid, dry or crystallized soap 27 is held and absorbed into the patch material.

When using the present invention to wash an item, for example, an automobile, the automobile would first be sprayed with water, and soap would be poured or placed into the pocket 26. If mit A is dry, then the mit may be soaked with water to begin the activation process. Particularly, the wetting of patch 12 makes drawing the soap to the surface of patch 12 easier. When the automobile is washed with the mit, the soap is transmitted onto the surface of the vehicle allowing the vehicle to be washed in its entirety without the need to emerse mit A in a bucket of soap or use some other source of soap to continue washing. The material of patch 12 is saturated with soap so that there is a distribution and transmission of soap throughout the washing cycle, allowing the user to eliminate the need to reapply the soap or other cleaning agent, and thereby accelerate the cleaning process, eliminate the need for other types of traditional cleaning accessories (e.g. buckets, rags, etc.), and avoid spillage and clean-up issues.

The present invention decreases the wash time that is necessary by eliminating the need to obtain the cleaning agent, i.e. soap, from a separate source and also eliminates the need of filling a bucket with water and soap, and further provides the ability to wash the vehicle in one continuous operation thereby allowing for a one rinse cycle process.

Figure 9:
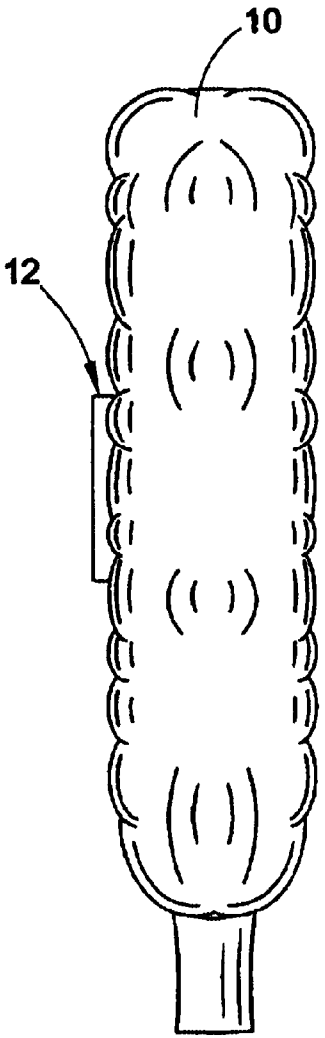
FIGS. 7–9 illustrate a patch wherein soap is infused into the patch area.
Figure 8:
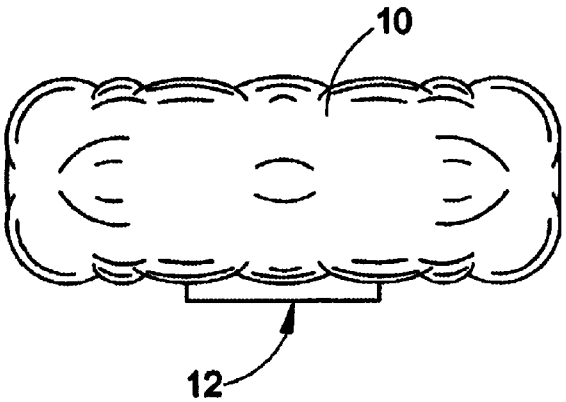
Figure 7:
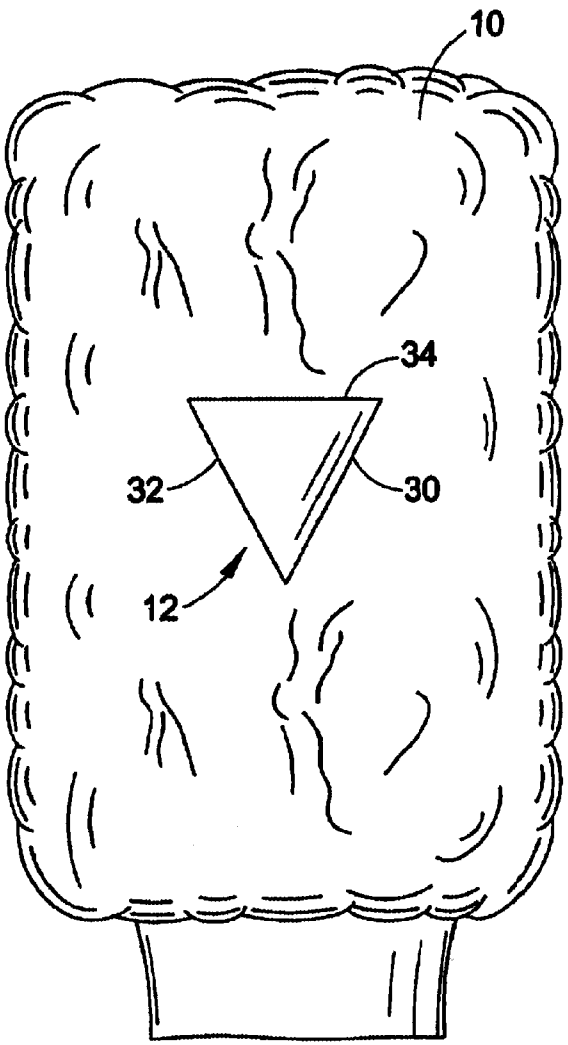

In a second embodiment, as shown in FIGS. 7, 8 and 9, patch 12 is attached to washing area 10 on all sides, 30, 32 and 34 of patch 12. Thus, as shown in, FIG. 8, which is a top view of FIG. 7, and FIG. 9 which is a side view of FIG. 7, no pocket is formed. Therefore, in order to apply the soap in this embodiment, it is necessary to use a material for patch 12 which will absorb a liquid soap applied thereto, such a material including but not limited to a sponge material.

Figure 12:
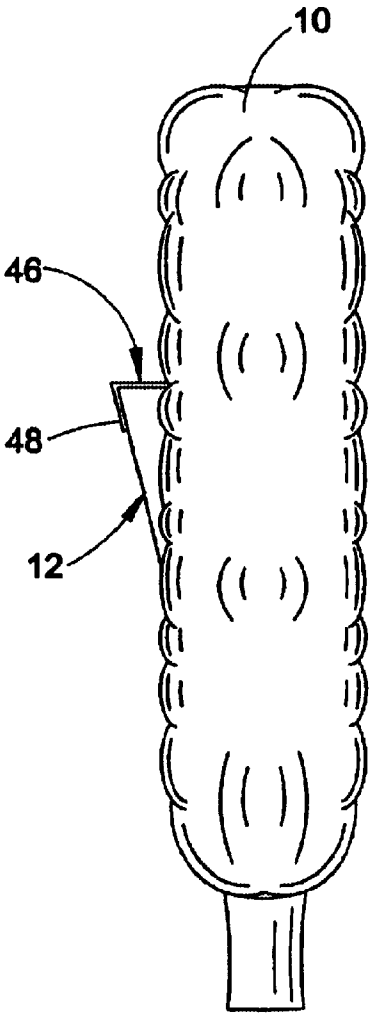
FIGS. 10–12 describe an embodiment of the present invention including a flap to close a pocket area of the mit.
Figure 11:
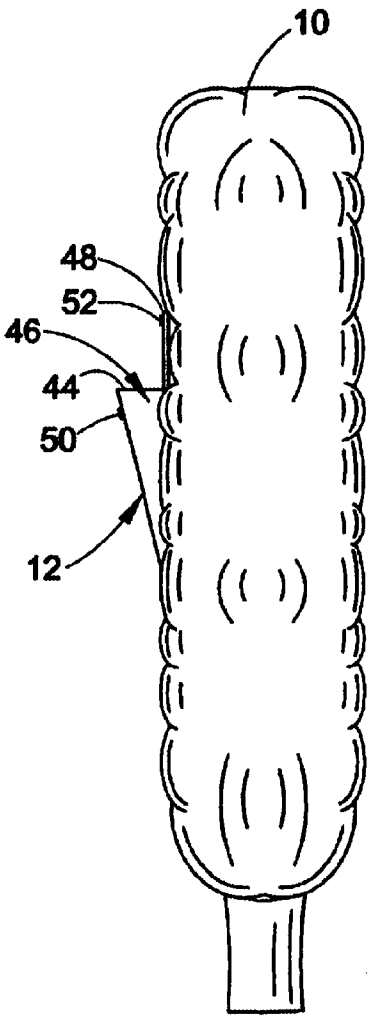
Figure 10:
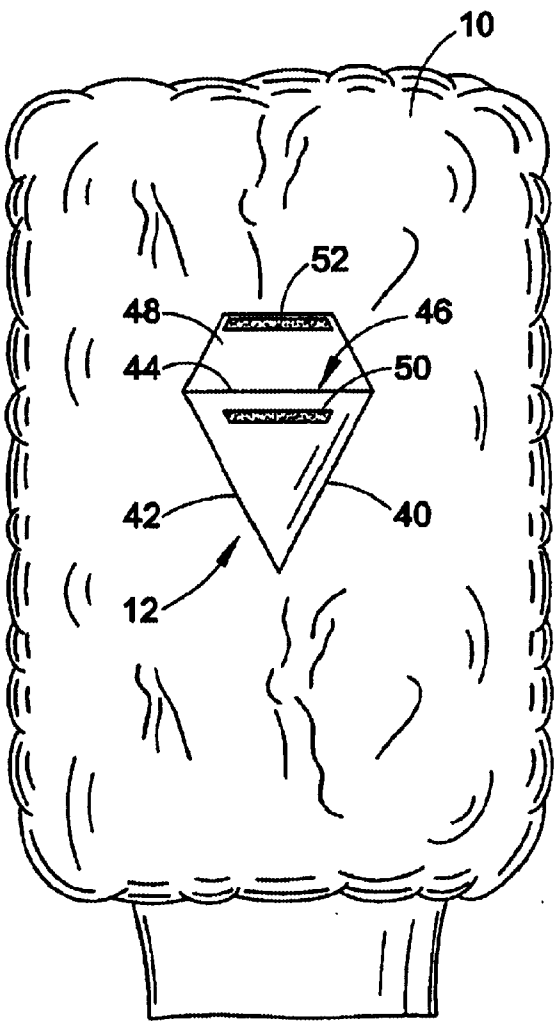

Turning attention to a third embodiment of the present invention, as shown in FIGS. 10, 11 and 12, patch 12 has sides 40 and 42 attached to washing area 10. Upper portion 44 is not attached, thereby allowing formation of pocket 46. In addition, a flap portion 48 is provided which, after provision of soap into pocket 46 may be used to close the pocket such that soap will be maintained more securely within the inner areas of pocket 12. Flap 48 may be attached to an outer surface of patch 12 by velcro connections 50, 52.

Figure 15:
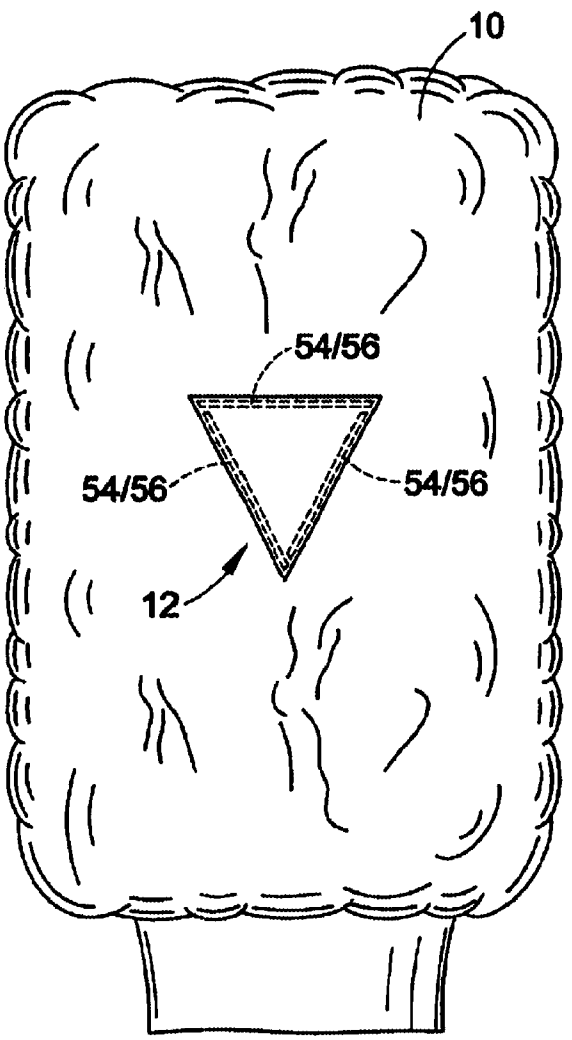
FIGS. 13–15 illustrate a fourth embodiment of the present invention where a replaceable/disposable patch is used.
Figure 14:
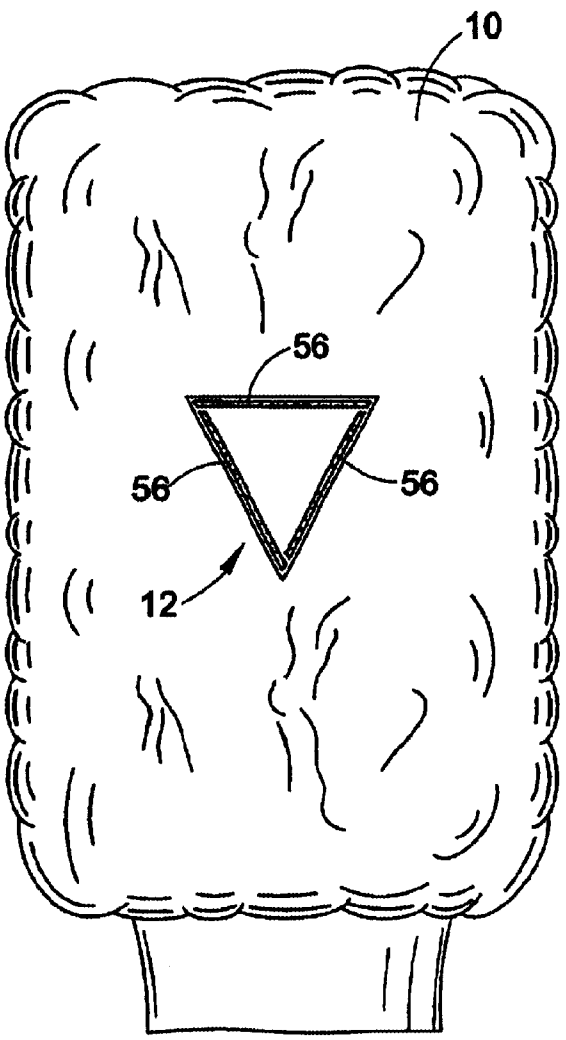
Figure 13:
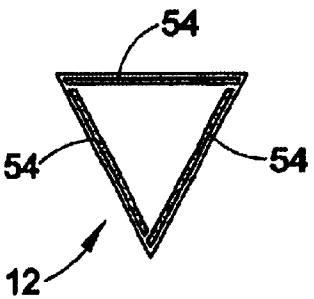

In a fourth embodiment, as shown in FIGS. 13–15, a patch 12 such as shown in FIG. 13 may have a cleaning agent material infused within its structure. It is to be noted that FIG. 13 shows the backside of patch 12 of this embodiment. On the backside of patch 12 are velcro or other type of non-permanent connection strips 54. Turning to FIG. 14, washing area 10 has on its front surface opposing strips 56 in a pattern matching that shown on patch 12. A user will simply attach strips 54 of patch 12 to strips 56 of washing area 10, thereby providing patch 12 with an infused washing agent washing area 10 as shown in FIG. 15. By this use, soap does not need to be added by the user, but rather individual infused patches will simply be used until no more soap exists in the patch, and patch 12 will then be discarded and a new patch 12 used.

Figure 17:
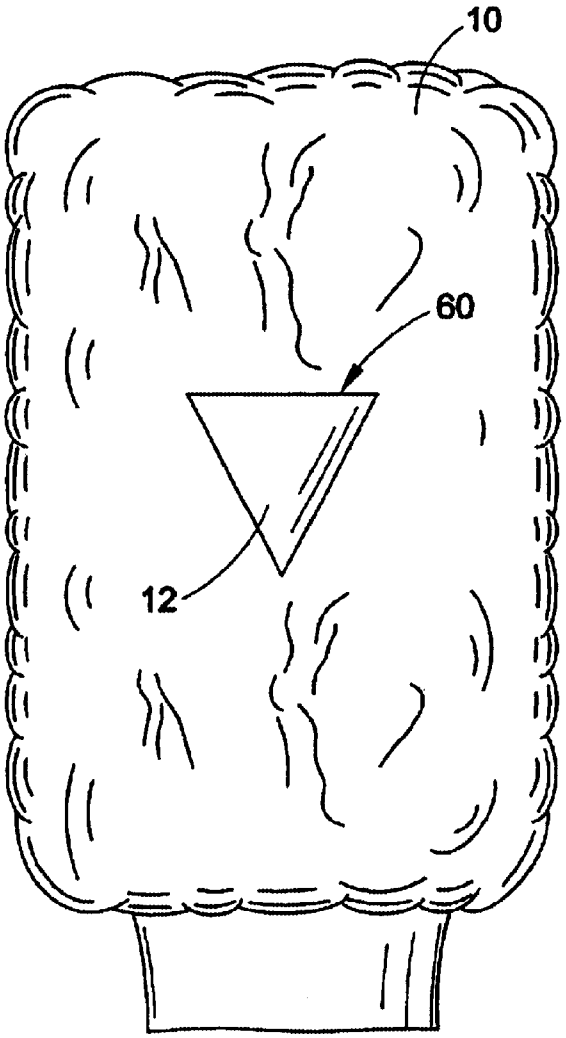
FIGS. 16 and 17 illustrate the use of a backing material for improving the transmission of a cleaning agent to a surface.
Figure 16:
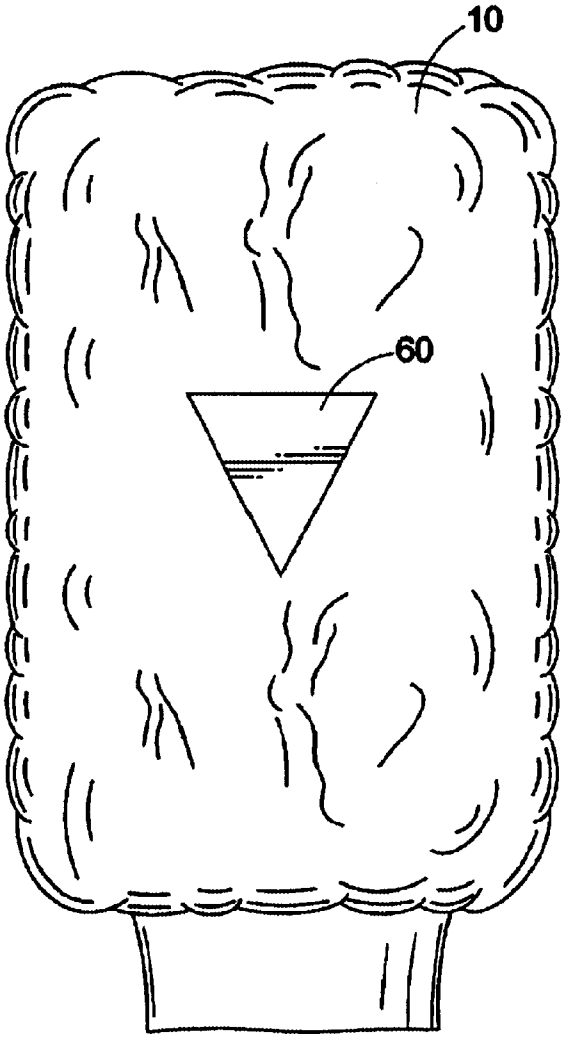

Turning attention to FIG. 16, while in the previous discussions, patch 12 was connected directly to washing area 10, in another embodiment, prior to attaching patch 12 to washing area 10, a backing member 60 is applied to washing area 10. Backing member 60 may be constructed from a number of non-absorptive materials, including plastics. Once backing member 60 is attached to washing area 10, and as shown in FIG. 17, patch 12 may be attached. By this design, the non-absorptive material 60 inhibits soap from being transmitted into the inner cleaning area 10 behind patch 12. This forces the soap out onto the surface of patch 12 in a more efficient manner.

Figure 18:
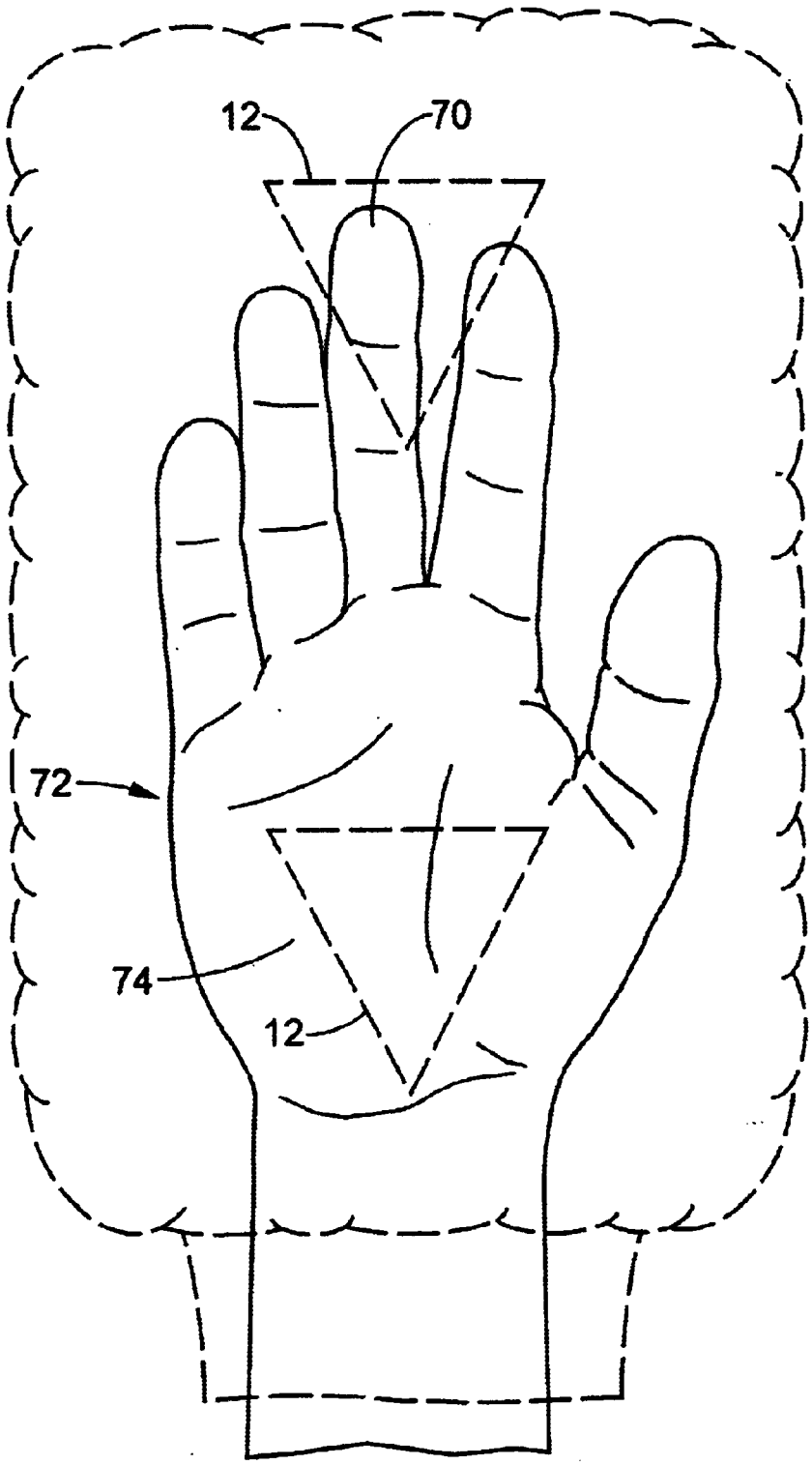
FIG. 18 illustrates control of the delivery of the cleaning agent in accordance with the present invention.

As illustrated in FIG. 18, patch 12 is located on cleaning area 10 at a location that allows control of the pressure applied to the patch to be increased by application of fingers 70 of a user's hand 72. Particularly, by placement of patch at this location, the user can apply pressure through the fingers onto the patch to increase the amount of pressure between the patch and the surface being cleaned. This will increase the rate of transmission of soap to the cleaning surface. Such an arrangement provides an increased control for application of a cleaning agent to an area which may require a higher level of cleaning agent. It is understood that patch 12 may be placed near the palm 74 whereby pressure may be also applied to increase the amount of transmission.

A specific combination of the previously described components which may be used to construct a mit according to the present invention, includes the use of the polyester material for the mit fleece and the PORON (an open cell urethane foam) open-celled micro-cellular polyurethane for the patch. Using this combination, the mit of not only absorbs the cleaning agent that is placed into the pouch area, but the PORON (an open cell urethane foam) then acts to infuse the fleece material with the cleaning agent enabling it to provide sudsing and foaming action within the fleece.

In other words, the pouch acts as a reservoir for the cleaning agent and as an injector or infuser to the fleece mit material. This infusion into the fleece mit material, provides a more thorough and quicker sudsing action for the entire mit as opposed to existing mit technology. The existing technology primarily uses the pouch to hold a soap and allow the soap to be rubbed onto the surface. However, in the present embodiment the infusing of the fleece mit material through use of the PORON (an open cell urethane foam) pouch produces a cleaning system which quickly supplies cleaning agent to the overall mit. Thus, the infusion quickly spreads the cleaning agent throughout the mit.

The PORON (an open cell urethane foam) patch material is, again, an open-celled micro-cellular polyurethane. It is also a high density flexible cellular product manufactured by continuously casting and curing mechanically frothed urethane intermediates into a desired thickness. By controlling the chemistry and density, the properties of the PORON (an open cell urethane foam) materials can be uniquely configured for specific cleaning uses.

Specific attributes of the PORON (an open cell urethane foam) urethane which permits the infusion of the fleece material includes that it is a high density material with a standard range of 15–30 pcf. The molecular structure allows for an average size of the PORON (an open cell urethane foam) urethane to be approximately 100 microns and in a very uniform format. Unlike other cellular materials, the PORON (an open cell urethane foam) cellular urethane provides for it to be an open-cell material. Particularly, PORON (an open cell urethane foam) urethane materials have small openings between most of the cells producing a breathable material. When compressed, these openings are shut off creating a superb sealing capability.

It is believed that these features of PORON (an open cell urethane foam), when implemented in conjunction with the polyester fleece material, are what allow for the rapid infusion of the mit. For example, the wide spread infusion to the front as well as sides and back of the mit is assisted by the uniform open cell structure of the PORON (an open cell urethane foam). Further, when the material is compressed and the openings are shut, the cleaning agent does not move back into the PORON (an open cell urethane foam) but is absorbed by the fleece material. Once the patch is de-compressed additional cleaning agent then moves out of the open-cell material.

With more particular attention to the preliminary product properties of a PORON® 4701–50 (an open cell urethane foam) high modulous grade material, attention is directed to the following chart.

| PROPERTY | TEST METHOD | VALUE |
|---|---|---|
| Density, lb./ft$^3$ (kg/m$^3$) | ASTM D3574 - Test A | 30 (480) |
| Tolerance, % | — | ±10 |
| Thickness, inches (mm) | — | 0.017 - (0.43)<br>0.020 - (0.50) |
| Tolerance % | — | ±0.003" |
| Physical | | |
| Standard Color, (Code) | — | Black (04) |
| Compression Set, %, | ASTM D3574 - Test D | 5 |
| | ASTM D3574 - Test D | 10 |
| | ASTM D3574 - Test J/ | 5 |
| Compression Force | 0.2"/min. Strain Rate. | 15–45 |
| Dimensional Stability, % | 22 hrs. @ 176° F. (80° C.) | ±2.5 |
| Fogging | SAE-J1756 | Pass |
| Hardness, Durometer, | ASTM D2240-97 | 55 |
| Outgassing | ASTM E595 | 0.9 |
| Total Mass Loss (TML), % | 24 hrs. @ 257° F. (125° C.) @ <7 × 10$^{-3}$ Pa | |
| Tear Strength, pli, min. | ASTM D624 - Die C | 9 (1.5) |
| Tensile Elongation, % | ASTM D3574 - Test E | 90 |
| Tensile Strength, psi, | ASTM D3574 - Test E | 160 (1106) |
| Thermal | | |
| Temperature Resistance | | |
| Embrittlement | ASTM D746 | −40° F. - (−40° C.) |
| Recommended Constant | | 158° F. - (70° C.) |
| Thermal Conductivity, | ASTM C518 | 0.090 (0.63) |
| Coefficient of Thermal Expansion | | 2.3–3.1 × 10$^{-4}$ in/in/° C. |
| Electrical | | |
| Surface Resistivity, | ASTM D257 | 7 × 10$^{12}$ |
| Dielectric Constant, K' | ASTM D150 | 1.63 |
| Dissipation Factor, tan | ASTM D150 | 0.05 |
| Dielectric Strength, | ASTM D149 | 50 |
| Environmental | | |
| Corrosion Resistance | AMS 3568 | Pass |
| Mildew/Bacterial | ASTM G-21-96 | Good |
| Ozone Resistance | GM4486P | Pass |
| Skin Contact | Schwartz and Peck | No Irritation |
| Staining | ASTM D925-88 | No stain |
| UV Resistance | ASTM G53-95 | Good |
| Water Absorption, % wt | AMS 3568 | 2 |
| Immersion Testing, % wt | ASTM D570 | 5 |

-continued

| PROPERTY | TEST METHOD | VALUE |
|---|---|---|
| Chemical | | |
| Static Solvent Resistance | Specimens immersed for 10 min. in 75% Naptha, Antifreeze and Water 50/50 | No tackiness or surface deterioration |
| Additional Solvent Resistance | | No tackiness or surface deterioration |

It is to be understood that while the present embodiments have shown patch 12 to be in the form of a triangle, other shapes are of course also contemplated in the present invention including but not limited to circles, rectangles, stars, or even specific commercial emblems.

Further, while the present invention has been described in accordance with a mit, the technology described herein may also be applicable to cleaning gloves or cleaning towels.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A cleaning product comprising:

a polyester fleece cleaning area used for cleaning an item; and an open celled micro-cellular polyurethane patch attached to the cleaning area in the form of a pocket into which is placed a cleaning agent, the patch made of a material configured to absorb the cleaning agent and infuse the cleaning area to cause a foaming of the cleaning area, whereby the cleaning agent is provided to a surface of the item being cleaned, wherein a user of the cleaning product can clean the item without the need of re-loading the cleaning area with the cleaning agent during a cleaning operation.

2. The cleaning product according to claim 1 wherein the cleaning product is in the form of a mitt and wherein the patch is placed into direct contact with the surface.

3. A cleaning mit used for cleaning an item by applying soap to a surface of the item, comprising:

a cleaning area formed into the shape of a mit into which a human hand can be placed, the cleaning area existing on a front, sides, and back of the mit;

an open celled micro-cellular polyurethane absorptive/transmissive material designed in the form of a patch which is capable of absorbing a cleaning agent and infusing the cleaning area existing on the front, sides and back of the mit, whereby the cleaning agent is supplied to a surface of the item being cleaned, the patch connected to a front surface of the cleaning area;

a cuff portion designed to be smaller than an inner portion of the cleaning area such that a user's hand will remain inside the mitt during the cleaning procedure;

the cleaning area and the patch formed in relationship to form a pocket, secured by a flap, in which is repeatedly placed a cleaning agent;

the patch being located at a position on the cleaning area such that portions of a user's hand is able to selectively apply pressure to the patch, whereby the user is able to control the transmission of the cleaning agent to the surface of the item being cleaned; and a non-absorptive material being interspersed between the cleaning area and the patch, such that the cleaning agent is inhibited from coming into contact with the cleaning area corresponding to the patch location, thereby dispensing said cleaning agent more efficiently.

* * * * *